US005464584A

United States Patent [19]

Yeh

[11] Patent Number: 5,464,584

[45] Date of Patent: Nov. 7, 1995

[54] PROCESS FOR MAKING SOIL AND STAIN RESISTANT CARPET FIBER

[75] Inventor: Ling Yeh, Asheville, N.C.

[73] Assignee: BASF Corporation, Parsippany, N.J.

[21] Appl. No.: 289,056

[22] Filed: Aug. 4, 1994

Related U.S. Application Data

[60] Division of Ser. No. 171,369, Dec. 20, 1993, abandoned, which is a continuation-in-part of Ser. No. 914,680, Jul. 15, 1992, abandoned.

[51] Int. Cl.[6] ..... D01D 5/24; D01D 5/253; D02J 1/08; D06M 15/19

[52] U.S. Cl. ..... 264/103; 264/129; 264/130; 264/177.14; 264/210.8; 264/211.14; 264/211.15

[58] Field of Search ..... 264/103, 129, 264/130, 168, 177.14, 210.8, 211.14, 211.15, 555

[56] References Cited

U.S. PATENT DOCUMENTS

| | | | |
|---|---|---|---|
| 3,164,949 | 1/1965 | Pitzl | 428/397 |
| 3,220,173 | 11/1965 | Pitzl | 428/397 |
| 3,900,624 | 8/1975 | Schare | 428/371 |
| 4,075,378 | 2/1978 | Anton et al. | 428/374 |
| 4,097,546 | 6/1978 | Lofquist . | |
| 4,192,754 | 3/1980 | Marshall et al. | 252/8.8 |
| 4,325,322 | 4/1982 | Louch et al. | 118/410 |
| 4,472,481 | 9/1984 | Snooks et al. | 428/397 |
| 4,522,774 | 6/1985 | Donnelly et al. | 264/168 |
| 4,565,717 | 1/1986 | Hosegood et al. | 427/339 |
| 4,680,212 | 7/1987 | Blyth et al. | 428/395 |
| 4,770,938 | 9/1988 | Peterson et al. | 428/395 |
| 4,780,099 | 10/1988 | Greschler et al. | 8/115.6 |
| 4,822,373 | 4/1989 | Olson et al. | 8/115.6 |
| 5,024,869 | 6/1991 | Yeh et al. | 428/97 |
| 5,061,763 | 10/1991 | Moss III et al. | 525/502 |
| 5,073,442 | 12/1991 | Knowlton et al. | 428/267 |
| 5,208,107 | 5/1993 | Yeh et al. | 428/397 |

FOREIGN PATENT DOCUMENTS

| | | |
|---|---|---|
| 0012877 | 7/1980 | European Pat. Off. . |
| 0201812 | 11/1986 | European Pat. Off. . |
| 0242496 | 10/1987 | European Pat. Off. . |
| 0332343 | 9/1989 | European Pat. Off. . |

OTHER PUBLICATIONS

Cooke and Weigmann, "Stain blockers for nylon fibres", *Review of Progress in Coloration and Related Topics*, vol. 20, 1990, pp. 10–18.

*Primary Examiner*—Leo B. Tentoni
*Attorney, Agent, or Firm*—Karen M. Dellerman

[57] ABSTRACT

A method for producing carpet yarn produces yarn having substantial soil hiding, soil repelling and resistance to staining with acid dye characteristics. The yarn is made by forming at least one hollow trilobal fiber from a molten nylon polymer having an amine end group level below about 25 meq/kg, the fiber having a modification ratio of about 2 and a void volume of at least 3%; quenching the formed fiber sufficiently to solidify the molten nylon; immediately after quenching, at a yarn speed of at least 300 mpm, finishing the fiber with spin finish containing fluorochemical; fully drawing the finished fiber; texturing the finished yarn by a hot fluid texturing process; and subsequently, applying to the textured yarn a sulfonated stainblocker, the stainblocker being heated to at least 50° C. and applied while the fiber temperature is at least about 100° C. in the stainblocker application step. The yarn travels at a rate sufficient to permit fixation of the stainblocker while minimizing penetration of stainblocker into the yarn.

10 Claims, 2 Drawing Sheets

PROCESS FOR MAKING SOIL AND STAIN RESISTANT CARPET FIBER

This is a divisional of application Ser. No. 08/171,369 filed Dec. 20, 1993, now abandoned, which in turn was a continuation of Ser. No. 07/914,680 filed Jul. 15, 1992, and now abandoned.

FIELD OF THE INVENTION

The present invention relates generally to carpet fibers and, more particularly, to carpet fibers having substantial soil hiding, soil repellent and acid dye stain resistant characteristics and a process for producing such fiber.

BACKGROUND OF THE INVENTION

As used herein, the term "modification ratio" ("MR") describes the ratio of the radius of the circle circumscribing the lobes of a lobal fiber to the radius of the circle inscribed by the core of that fiber. The term "fiber" encompasses both staple fibers and continuous filaments. "Yarn" means a continuous strand of fiber in a form suitable for knitting, weaving, or otherwise intertwining to form a fabric.

Synthetic fibers used to make carpet yarn and ultimately carpet must possess certain characteristics in order for the carpet made from these fibers to be durable and satisfactory floor covering. Due to high volume foot traffic, carpets tend to become dull, dirty and reveal paths where people habitually tread, e.g., the center of a hallway. As a consequence, carpets should resist soiling for long periods and hide any soil which does accumulate. As a further attribute, a carpet should be resistant to staining by materials commonly found in households and commercial environments. One notorious source of staining is the acid dyes found in beverages like fruit juice and colored children's drinks. Various efforts have been directed to producing carpet fibers which possess as many of these attributes as possible.

Hollow trilobal fibers are known to generally provide soil hiding characteristics when used to make carpet. For example, U.S. Pat. No. 5,208,107 which issued May 4, 1993 describes a hollow trilobal fiber.

Providing nylon polymers with reduced amine end group levels is known. For example, U.S. Pat. No. 4,097,546 to Lofquist describes the use of monocarboxylic acid or dicarboxylic acid as a molecular weight regulator which also decreases the concentration of amine ends, preferably to 15 to 25 meq/gm. Reducing amine end group levels contributes to acid dye resistance by blocking the amine receptors for acid dyes.

Application of fluorochemicals to yarn is known to resist soil and repel oil. For example, U.S. Pat. No. 4,192,754 to Marshal et al. describes a spin finish containing a fluorochemical compound.

Stainblockers for imparting acid stain resistance to polyamide carpeting yarns are known as well. While present stainblocker technology encompasses several chemical classes, of most concern here are certain aromatic-formaldehyde condensation products, some of which are also known as novolacs, and other sulfonated materials. U.S. Pat. No. 5,061,763 to Moss III et al. describes a stainblocker composition which is prepared by polymerizing an acrylic monomer in the presence of sulfonated aromatic-formaldehyde condensation products. Patents describing the use of novolacs as stainblockers for carpets are U.S. Pat. No. 4,822,373 to Olson et al., which describes a polyamide treated substrate having applied thereto a mixture of partially sulfonated novolac resin and a polymethacrylic acid or copolymer thereof. U.S. Pat. No. 4,780,099 to Gresschler et al. describes polyamide fibers which are made stain resistant by treating them with a sulfonated naphthyl or sulfonated phenol formaldehyde condensation product at a pH of between 1.5 and 2.5.

Various ingredients including sulfonated phenolic resins, sulfonated aromatic compounds, compounds of sulfonated phenolics and aldehydes, modified wax emulsions, fluorochemicals, acrylics and organic acids of low molecular weight have been variously combined to provide stain resistance upon application to polyamide carpet. For example, U.S. Pat. No. 5,073,442 to Knowlton et al. describes such a composition.

Yet, most efforts to combine various known agents onto the fiber itself have been unsuccessful to some degree. Most efforts to combine various known agents to carpet yarn for soil repellency and stain resistance have been only partially successful and then only at relatively slow speeds (less than 100 mpm). Some of the difficulties encountered include incompatibility of fluorochemical finish and stainblocker, tackiness of the stainblocker and migration of stainblocker to the fiber center. Surprisingly, the present invention allows a particularly effective treatment to carpet fibers through control of application conditions at high speeds. The fiber produced by this process has excellent properties that were previously unachievable in a fiber. These properties include improved soiling and staining resistance, soil resistance, superior cover, superior appearance retention, low flammability, a firm hand and ease of processing.

SUMMARY OF THE INVENTION

The present invention provides a method for producing carpet yarn having substantial soil hiding, soil repellent and resistance to staining with acid dyes by forming at least one hollow trilobal fiber from a molten nylon polymer having an amine end group level below about 25 meq/kg, the fiber having a modification ratio of at least 2 and a void volume of at least 3%; quenching the formed fiber sufficiently to solidify the molten nylon; immediately after quenching, at a yarn speed of at least 300 mpm, finishing the fiber with spin finish containing fluorochemical; fully drawing the finished fiber; texturing the finished yarn by a hot fluid texturing process; and subsequently, applying to the textured yarn a sulfonated stainblocker, the stainblocker being heated to at least 50° C. and applied while the fiber temperature is at least about 100° C. During the applying, the yarn travels at a rate sufficient to permit fixation of the stainblocker while minimizing penetration of stainblocker into the yarn.

Also provided is a carpet yarn which resists staining by acid dyes and has substantial soil hiding and soil repellent characteristics. The yarn includes 10 to 35 denier per filament hollow fibers defining a trilobal surface with a modification ratio of at least 2 and a void volume of at least 3 and formed from a nylon polymer having an amine end group level below about 25 meq/kg. Fluorochemical is applied to the surface of said fiber as a spin finish and stainblocker is applied to the spin finished surface immediately after texturing.

It is an object of this invention to prepare polyamide carpet yarn which resists staining by acid dyes.

Another object of this invention to prepare polyamide carpet fiber which resists and hides soil.

A further object of this invention is to apply stainblockers to carpet fiber such that the stainblockers resist penetrating into the fiber's interior and yet are fixed primarily on the surface of the fiber.

After reading the following description, related objects and advantages of the present invention will be apparent to those ordinarily skilled in the art to which the invention pertains.

DETAILED DESCRIPTION OF THE PREFERRED EMBODIMENTS

Figure 1:
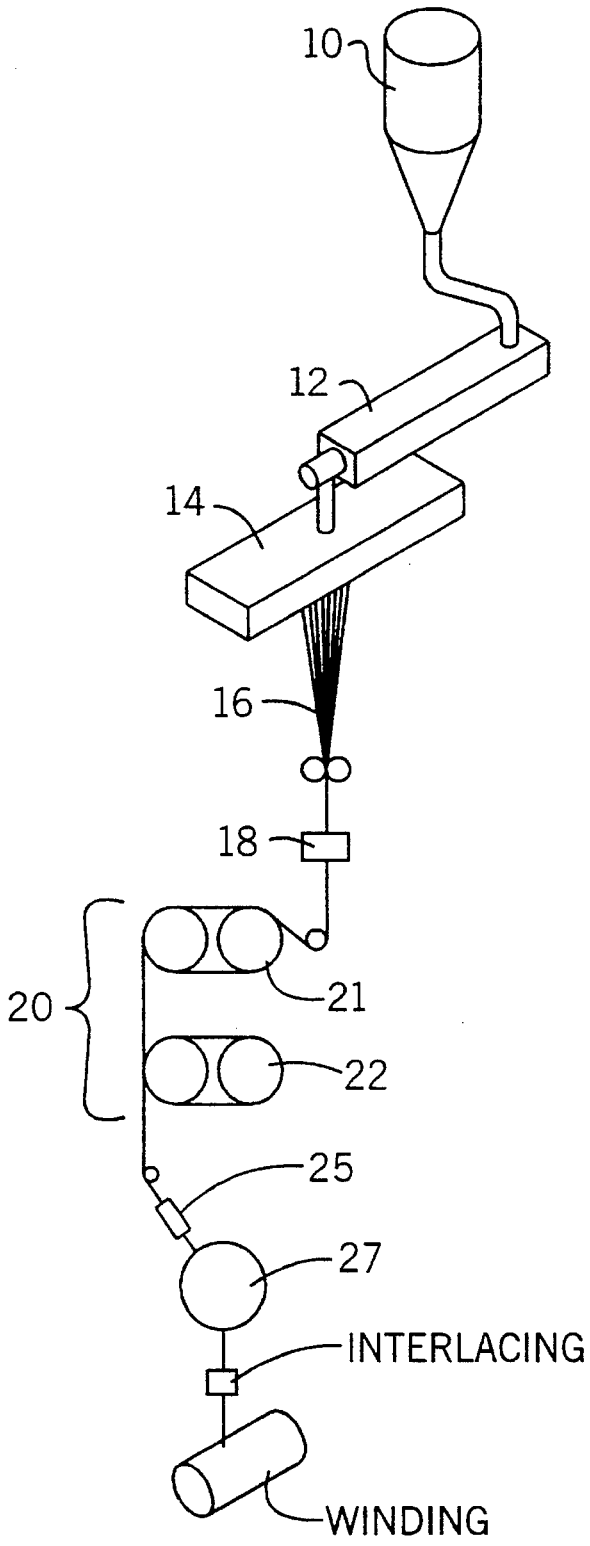
FIG. 1 is a thread flow diagram of the process of the present invention.

To promote an understanding of the principles of the present invention, descriptions of specific embodiments of the invention follow and specific language describes the same. It will nevertheless be understood that no limitation of the scope of the invention is thereby intended, and that such alterations and further modifications, and such further applications of the principles of the invention as discussed are contemplated as would normally occur to one ordinarily skilled in the art to which the invention pertains.

A first embodiment of the present invention involves a method for producing carpet yarn which has resistance to staining by acid dyes and soiling. The method involves forming and quenching a fiber from a nylon polymer. The quenched fiber is finished with a spin finish containing fluorochemical; and subsequently, a stainblocker is applied at 50°–95° C. immediately after the texturizing operation while the fiber is no less than 100° C.

The first step involves forming the fiber. Fibers preferred in the invention are hollow trilobal fibers having regular or irregular cross-sections, e.g., lobe spacing may be even or uneven. Suitable modification ratios include 2 and higher. The void volume is at least 3% of the fiber cross-section, preferably 3–8% and most preferably, around 5%. The fiber denier per filament ("dpf") should be suitable for the requirements of carpet yarn, that is, from 10–35 dpf, preferably from 15–30, and most preferably, from 20–25 dpf. Continuous filament yarns are preferred.

Useful nylon polymers include any fiber forming polyamide, especially nylon 6 and nylon 6,6. Conventional melt spinning techniques may be used according to the polymer being extruded. Spinning conditions should vary according to the cross-section to be made, i.e., the denier, modification ratio and void volume. A spinneret suitable for producing the hollow trilobal should be used. One source of spinnerets is the Kasen Nozzle Company.

The nylon polymer may be modified with an amine end group blocker to produce an amine end group level below about 25 meq/kg of polymer. Amine end groups ("AEG") may be measured by dissolving nylon chip or dry yarn in a mixture of phenol and methanol solution at 50° C. and titrating the solution with hydrochloric acid. The results are reported as milliequivalent of AEG per kilogram of sample. Two suitable amine end group blockers are caprolactone and butrolactone. In most cases, about 0.4% by weight of caprolactone or 0.6% by weight of butrolactone will produce the desired AEG levels. Those of ordinary skill in the art, however, will recognize that extrusion temperature, reaction time and pressure affect AEG levels. The amine end group blocker is preferably added as a liquid at the throat of the extruder. Alternatively, the end group blocker may be added during the production of chip or during polymerization of the nylon 6. Other methods of incorporating the amine end group blocker may also be suitable.

Pigments and other colorants and, optionally, delusterants, flame retardants and other additives may be added to the polymer according to the standard techniques for adding materials of the type. Pigments are available from various sources. Pigments exhibiting flame retarding action such as carbon black and others disclosed in U.S. Pat. No. 5,024,869 to Yeh et al. are especially preferred. When pigments are used, they may be added as a pigment concentrate which is blended with the chip or added as a melt into a side-arm extruder. Again, all known methods for pigmenting (or adding colorant to) fiber may be used.

After extrusion, the still molten strands are quenched according to known methods of quenching extruded fibers. For example, cooled air (14°–17° C.) flowed at 90 to 110 ft/min is crossed-flowed to the freshly extruded molten filaments. Those ordinarily skilled in the art will readily grasp that the quenching conditions can and should be varied to achieve target fiber denier, modification ratio and void volume.

Following quenching, the fiber is finished with a spin finish containing a fluorochemical. Advantageously, and according to the present invention, the fluorochemical finish is applied while the filaments are still fresh from spinning and before other finishes, etc., are applied to the filament surfaces. According to the invention, the finish is supplied to yarn traveling at about 300–1300 mpm. It is believed that young yarn (freshly spun) enables the fluorochemical application speeds possible with the present invention. Preferably the fluorochemical is applied at a rate sufficient to yield 350–750 ppm fluorine owl, and most preferably, 500 ppm. One suitable applicator for applying the fluorochemical containing spin finish is described in U.S. Pat. No. 4,325,322, incorporated herein by reference.

There are a variety of fluorochemicals available for this purpose. Fluorochemical finishes featuring low flammability are especially preferred. They include those available from Minnesota Mining and Manufacturing Company ("3M"), St. Paul, Minn. Preferred fluorochemicals include FX360 from 3M.

Alternatively, the yarn may be wound up after finishing but before drawing. (See FIG. 2.) Conventional wind-up techniques may be used.

The finished fiber, whether wound up or supplied directly from finishing should be drawn so that it is fully oriented. Typically, draw ratios of 2.7–3.5 are used. Most normally a draw ratio of 3.0 is used.

After drawing, the yarn is texturized. Hot fluid jet texturizing methods are used because they open the yarn structure. The jet texturizing method described in U.S. Pat. No. 4,522,774 is suitable, and this patent is incorporated herein by reference for the texturizing process taught therein.

Following texturizing, a sulfonated stainblocker is applied to the fiber. Suitable stainblockers include those available from 3M as FX661 and FX369 and from BASF Corporation, Parsippany, N.J., as BASF Stain Protector. The stainblocker must be applied while the fiber is hot from texturing. Preferably, the fiber is at least about 100° C. The stainblocker should be heated to about 50° C. or higher preferably at least 70° C. Application rates of at least about 4% owf are preferred. The stainblocker may be applied by several methods including spraying with a spray nozzle or atomizer. During this step the yarn is traveling at 1200–3500 mpm.

While not wishing to be bound by theory, it is believed that freshly texturized yarn has a more open structure. The open structure contributes to a quick reaction of the fiber with the stainblocker. But if the fiber was allowed to remain warm, the stainblocker would penetrate too far into the interior of the fiber. To effectively block staining, stainblockers should be present at or near the fiber surface. Therefore, while warm conditions improve reaction of the fiber with the stainblocker, they also encourage penetration of the stainblocker into the fiber. The fiber should be cooled rather immediately after application of stainblocker. The high yarn speeds contribute to quick cool down. Evaporation of the aqueous solvent is another factor in rapid cool down. The goal is to fix the stainblocker to the fiber with limited penetration. Limitations on the yarn speed are set at the lower end by the texturizing process and at the upper end by technology. The yarn must travel sufficiently fast for the texturizing process to operate, typically at the very least 500 mpm.

Turning now to the figures for further understanding, FIG. 1 is a thread flow diagram showing the present invention as a one-step process. FIG. 1 illustrates a thread flow diagram for a one-step process according to the present invention. Nylon chips are fed into chip hopper for supply to extruder 12. At extruder 12 (or chip hopper 10) various functional additives, e.g., pigments, AEG blockers, etc. may be added as discussed above. Extruder 12 melts the nylon and forces it to spin beam 14 where nylon filament 16 of the desired shape and denier are extruded and quenched. The spin finish containing fluorochemical is applied via applicator 18 and the yarn is passed to drawing stage 20 shown being accomplished by godet pairs 21 and 22 which operate at different speeds.

Following drawing, the yarn is textured by hot air bulking jet :25. Immediately following texturizing, stainblocker is applied by a suitable applicator 27. The yarn might then be interlaced and wound-up.

Figure 2:
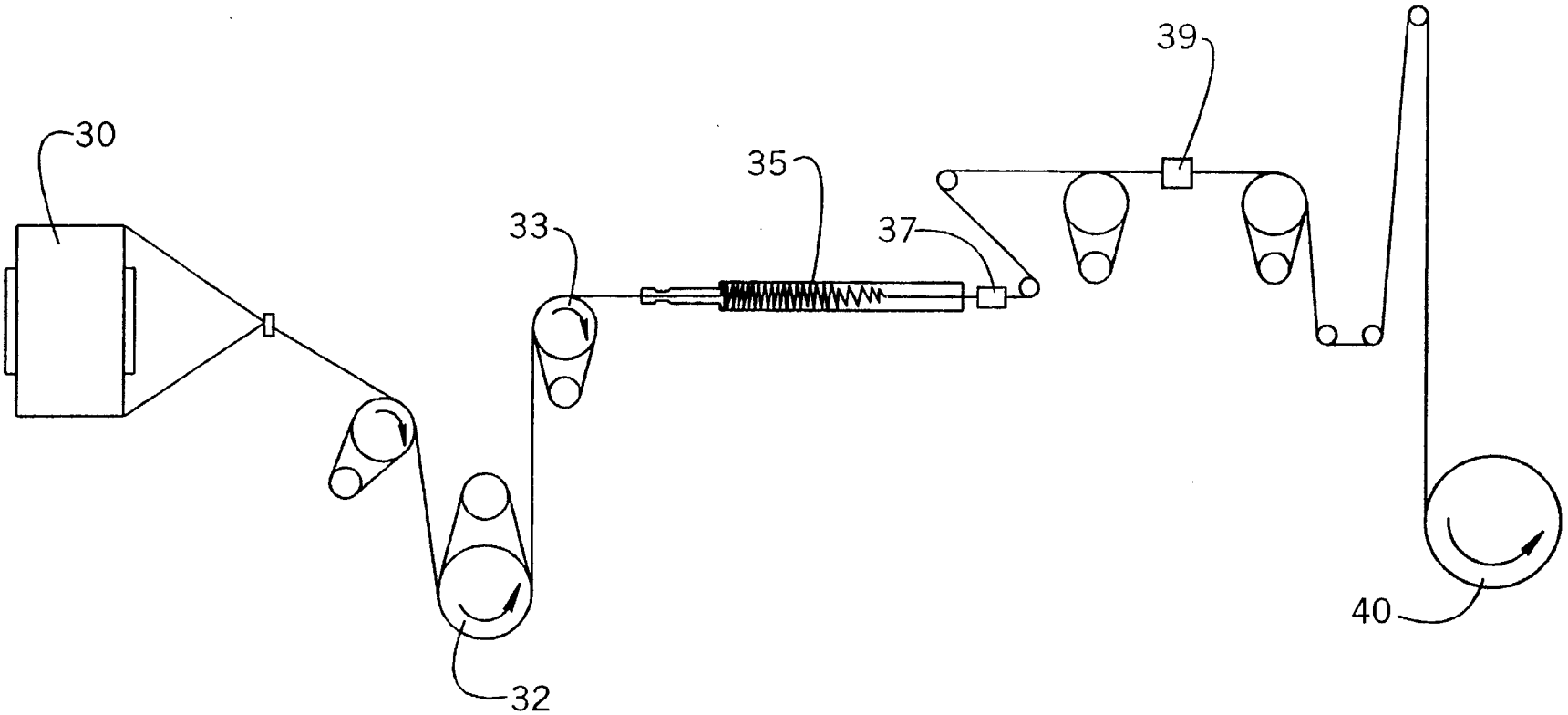
FIG. 2 is a thread flow diagram of an alternate embodiment of the process of FIG. 1.

FIG. 2 is a thread flow diagram of a two-step process of the present invention following wind-up after finish application. Yarn is extruded and finish applied as shown through applicator 18 (FIG. 1) after which it is wound-up as undrawn feed yarn 30 for later use. Undrawn feed yarn 30 is unwound and drawn between godet pairs 32, 33 operating at different speeds to facilitate drawing. After drawing, the yarn is texturized with hot air jet 35 and, while still warm from texturizing, stainblocker is applied with applicator 37. Air interlacing 39 and winding 40 may follow.

Another embodiment of the present invention is carpet yarn. The yarn may be prepared by the preceding process. Such a yarn provides good covering power and colorfastness with a firm hand. It exhibits desirable luster, has improved soiling and staining properties and has greater than 0.45 watts/cm$^2$ radiant panel flammability when flame retardants are added.

A further embodiment of the present invention is a method for applying stain-blockers to carpet yarn.

The invention will be described by reference to the following detailed examples. The Examples are set forth by way of illustration, and are not intended to limit the scope of the invention. In the Examples, all parts are part by weight unless otherwise specified. In the Examples, the following procedures were followed to produce the data:

Cut Pile Carpets

Cut pile carpets are made by standard tufting methods from cabled and heatset yarns. Carpet construction is 35 oz./yd, ⅛ gauge and ⅝" pile height.

Level Loop Carpets

Loop pile carpets are made by standard tufting methods from non-heatset yarns. Carpet construction is 28 oz/yd, ⅛ gauge and ⅜ " pile height.

Soiling Test

3×6 ft dyed carpet samples are installed in a heavily traveled corridor for 100,000 passes. The samples are then cleaned with a standard vacuum cleaner or a steam extractor. A visual comparison is made for degree of soiling.

EXAMPLE 1

A trilobal hollow cross-section fiber, 2.7 MR and 5.0% void, is formed from nylon 6 (B700, relative viscosity of 2.7) having an amine end group level of about 20 meq/kg is made by adding 2% (based on polymer weight) butyrolactone in the extruder. The following spinning conditions are used:

| | | |
|---|---|---|
| 1. | Extruder temperature | |
| | Zone 1 | 265° C. |
| | Zone 2 | 270° C. |
| | Zone 3 | 275° C. |
| | Zone 4 | 280° C. |
| | Zone 5 | 280° C. |
| 2. | Extruder Pressure | 1800 PSI |
| 3. | Polymer Through | 280 g/min |
| 4. | Capillary Shape | trilobal |
| 5. | Capillary/Spinnerette | 68 |
| 6. | Denier | 1300 |

A fluorochemical is applied to the yarn during spinning and a stainblocker is applied during texturing. The fluorochemical spin finish is a mixture of fluorochemical (FX360 from 3M), lubricant, antistatic agent and emulsifier applied at a yarn speed of 800 mpm. The stainblocker is FX369 from 3M. The stainblocker is diluted by 50% with water, heated to about 70° C. and sprayed at 1.0 gallon per hour on a semiplug coming out of a texturing operation at about 150° C. and 1750 mpm. The amount of fluorochemical and stainblocker applied to the yarn is about 500 ppm fluorine and four percent stainblocker. Level loop and cut pile carpets are made as described. Floor wear and soil, tetrapod wear, and various stain tests are performed on these samples. The results are presented in TABLE 1.

EXAMPLE 2

[Comparative Example]

A comparative yarn example is made having a trilobal cross-section (MR=2.6) with no void and with an amine end group of 35 meq/kg. Normal spin finish without the fluorochemical is applied at 1.5% FOY. Cold demineralized water is sprayed to the hot yarn during the texturing operation. Level loop and cut pile carpets are made as described. The results of wear, soil and various stain tests are provided in Table 1.

TABLE 1

| | Red Food Color AATCC 175-1991 | Coffee Grey Scale | Soiling |
|---|---|---|---|
| Level loop carpet | | | |
| Example 1 | 9 | 4 | |
| Example 2 | 2 | 3 | |
| Heatset cut pile | | | |
| Example 1 | | | Moderate |
| Example 2 | | | Severe |

Although certain preferred embodiments of the invention have been herein described for illustrative purposes, it will be appreciated that various modifications and innovations of the procedures recited may be effected without departure from the basic principles which underlie the invention. Changes of this type are therefore deemed to lie within the spirit and scope of the invention.

What is claimed is:

1. A method for producing carpet yarn which has substantial soil hiding, soil repellent and resistance to staining with acid dyes comprising:

(a) forming at least one hollow trilobal fiber from a molten nylon polymer having an amine end group level below about 25 meq/kg, the fiber having a modification ratio of at least 2 and a void volume of at least 3%;

(b) quenching the formed fiber sufficiently to solidify the molten nylon;

(c) immediately after quenching, at a yarn speed of at least 300 mpm, finishing the fiber with spin finish containing fluorochemical;

(d) fully drawing the finished fiber;

(e) texturing the finished yarn by a hot fluid texturing process; and (f) subsequently, applying to the textured yarn a sulfonated stainblocker, the stainblocker being heated to at least 50° C. and applied while the fiber temperature is at least about 100° C., during said applying the yarn traveling at a rate sufficient to permit fixation of the stainblocker while minimizing penetration of stainblocker into the yarn.

2. The method of claim 1 and further comprising (g) winding up the finished yarn prior to drawing.

3. The method of claim 1 wherein said forming is of a fiber having a void volume of approximately 5%.

4. The method of claim 1 wherein said quenching is carried out with gas chilled to about 14°–17° C. supplied at about 90 to 110 ft/min.

5. The method of claim 1 wherein said finishing is with a fluorochemical applied to yield 350 to 750 ppm fluorine owf.

6. The method of claim 5 wherein said finishing is with a fluorochemical applied to yield about 500 ppm fluorine owf.

7. The method of claim 1 wherein said finishing is with a fluorochemical metered to a slotted applicator.

8. The method of claim 1 wherein said drawing is at a draw ratio of about 2.7–3.5

9. The method of claim 1 wherein said applying is carried out at 500 mpm or faster.

10. The method of claim 9 wherein said applying is carried out at 1000–3500 mpm.

* * * * *

UNITED STATES PATENT AND TRADEMARK OFFICE

CERTIFICATE OF CORRECTION

PATENT NO. : 5,464,584
DATED : November 7, 1995
INVENTOR(S) : Ling Yeh

It is certified that error appears in the above-indentified patent and that said Letters Patent is hereby corrected as shown below:

On the title page, delete the Appl. No. "289,056" and replace with —286,056—.

Signed and Sealed this
Seventh Day of May, 1996

Bruce Lehman

BRUCE LEHMAN

*Commissioner of Patents and Trademarks*

*Attest:*

*Attesting Officer*